US007607268B2

(12) United States Patent
Scherrer et al.

(10) Patent No.: US 7,607,268 B2
(45) Date of Patent: Oct. 27, 2009

(54) FALSE WALLS CONSISTING OF STRETCHED FABRIC AND JOINED BY AN INCLINED SEPARATING RIBBAND

(76) Inventors: Jean-Marc Scherrer, 5A, Rue du College, Riedisheim (FR) F-68400; Jean-Paul Scherrer, 76A, Avenue de la Lere DB, Mulhouse (FR) F-68100

( * ) Notice: Subject to any disclaimer, the term of this patent is extended or adjusted under 35 U.S.C. 154(b) by 203 days.

(21) Appl. No.: 10/589,250

(22) PCT Filed: Dec. 23, 2004

(86) PCT No.: PCT/FR2004/003363

§ 371 (c)(1),
(2), (4) Date: Dec. 14, 2006

(87) PCT Pub. No.: WO2005/064097

PCT Pub. Date: Jul. 14, 2005

(65) Prior Publication Data

US 2007/0158034 A1 Jul. 12, 2007

(30) Foreign Application Priority Data

Dec. 24, 2003 (FR) ..... 03 15370

(51) Int. Cl.
*E04B 1/00* (2006.01)
*E04B 5/00* (2006.01)
*A47H 23/00* (2006.01)
*A47H 13/00* (2006.01)

(52) U.S. Cl. ..... 52/273; 52/222; 52/506.05; 52/506.06; 160/327; 160/383; 160/391; 160/392

(58) Field of Classification Search ..... 403/373; 160/327, 392, 87; 248/317; 52/287.1, 519, 52/222, 738, 302, 238, 506.05, 273, 506.06
See application file for complete search history.

(56) References Cited

U.S. PATENT DOCUMENTS 3,323,819 A * 6/1967 Barker ..... 403/402
4,083,157 A * 4/1978 Anthonioz ..... 52/222

(Continued)

FOREIGN PATENT DOCUMENTS

DE 199 59 254 C 5/2001

(Continued)

*Primary Examiner*—Brian E Glessner
*Assistant Examiner*—Omar Hijaz
(74) *Attorney, Agent, or Firm*—Young & Thompson

(57) ABSTRACT

A false wall includes a stretched piece of fabric held on the periphery thereof by an edge attachable to ribbands fixed to the ceiling or walls of a building. The ribbands include a holding arrangement having two interspaced parallel wings, namely a first external large wing and a second, lower, internal wing that ends in a shoulder extending towards the first wing and ending at a distance there from that enables the edge to be guided through, to rest on the shoulder. The ribband includes a base and two holding arrangements provided with inclined wings that converge towards each other and the space between the ends thereof is such that the distance between the end of a large wing and the plane of the large wing of the holding arrangement opposite is equal to the distance separating the shoulder of the holding arrangement from the large wing associated therewith.

20 Claims, 1 Drawing Sheet

U.S. PATENT DOCUMENTS 5,009,540 A * 4/1991 Nolan ..... 160/327
5,029,422 A * 7/1991 Scherrer ..... 52/222
5,119,614 A * 6/1992 Rex ..... 52/649.3
6,431,251 B1 * 8/2002 Yerusalim et al. ..... 160/327
6,959,518 B2 * 11/2005 Cousin ..... 52/273
2006/0156667 A1 * 7/2006 Scherrer et al. ..... 52/506.07

FOREIGN PATENT DOCUMENTS

EP 0 338 925 A 10/1989
FR 2 827 621 A 1/2003
WO WO 9512721 A1 * 5/1995

* cited by examiner

FALSE WALLS CONSISTING OF STRETCHED FABRIC AND JOINED BY AN INCLINED SEPARATING RIBBAND

BACKGROUND OF THE INVENTION

1. Field of the Invention

This invention relates to a false wall consisting of a piece of fabric stretched around its periphery onto support elements fixed to the walls or the ceiling of a room.

2. Brief Description of the Related Art

Different types of false walls and particularly false ceilings are known, composed of a metallic ribband or a ribband made of a synthetic material provided with holding elements that will cooperate with complementary holding means provided around the periphery of the fabric. These holding means may be composed of visible ribbands, or as described in patent EP-B-0338925 of ribbands that are at least partly concealed from the eyes of users by the fabric itself.

When the surfaces of ceilings or walls are large, separating elements are arranged through these ceilings or walls, consisting of double ribbands that hold the fabric on both sides. Even when they make use of ribbands of the type mentioned above of the "invisible" type, these separating elements include a separation or space between two adjacent pieces of the fabric. Obviously, such a space is more acceptable when it is located around the periphery of the room, because it is less easily perceived by persons in the room.

BRIEF SUMMARY OF THE INVENTION

The purpose of this invention is to divulge a separating ribband composed of so-called "invisible" sections to significantly reduce the gap between two adjacent elements of the fabric surface.

The subject of this invention is a false wall composed of a stretched piece of fabric held around its periphery by an edge that can be attached to ribbands fixed to the ceiling and/or the walls of a room, in which the ribbands comprise a holding arrangement consisting of two parallel flanges at a spacing from each other, namely a first outer flange and a second lower inner flange that ends in a shoulder that extends towards the first flange and ends at a distance from it, to enable the edge to pass through, such that it can simply rest on the shoulder, characterised in that the ribband is composed of a base (B) and two holding arrangements, for which the flanges are inclined from the base such that the large flanges converge towards each other and that their ends are separated such that the distance between one large flange and the plane of the large flange in the opposite holding arrangement is equal to the distance separating the shoulder of the holding arrangement from the large flange associated with it.

The two holding arrangements will preferably be symmetrical about a plane perpendicular to the base and the flanges may be inclined by about 45° from the base.

Such a device has several advantages. Firstly, it means that a common space can be used to pass the peripheral edge of the fabric for each of the two holding arrangements.

This invention also enables the fitter to make a more or less pronounced curvature at the bottom of the two support elements, and to bring the ends of the highest flanges towards each other by a variable distance depending on the needs of the application considered.

In one embodiment of the invention, the base will be composed of a support plate, possibly provided with attachment elements on its face opposite the holding arrangements.

In one embodiment of the invention, the bottom of at least one of the large flanges will extend on the opposite side of the holding arrangements, by a flange perpendicular to the base. Preferably, the base of the two large flanges will thus be extended so that it can cooperate with a stirrup provided with a tie rod fixed to the ceiling of the room.

According to the invention, the separating ribband may be made in two parts that can be fixed together, particularly a plate common to their base.

BRIEF DESCRIPTION OF THE DRAWING FIGURES

We will now describe a non-limitative example of one embodiment of this invention with reference to the appended figures, wherein.

DETAILED DESCRIPTION OF THE PREFERRED EMBODIMENTS

Figure 1:
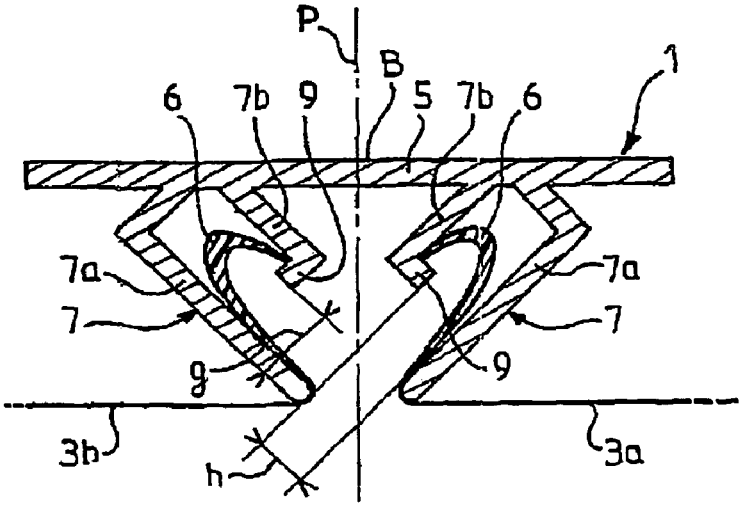
FIGS. 1 and 2 are sectional views of two embodiments of a separating ribband that holds two attachment edges of a fabric that are held on each side of the ribband.

FIG. 1 diagrammatically shows a false ceiling according to the invention that is composed of a separating ribband 1 that holds two stretched fabric elements, 3*a* and 3*b* respectively.

The separating ribband 1 that is preferably made from a ductile material such as aluminium enabling easy extrusion, essentially comprises a base plate 5 and two holding arrangements 7 that are symmetric about a plane P perpendicular to the base plate 5.

Each holding arrangement 7 is composed of two parallel flanges forming an angle of about 45° with the plate 5, namely a first outer flange 7*a* and a second inner flange 7*b* ending with a shoulder 9 extending towards the first flange 7*a*, the end of which is sufficiently far from the first flange (separation g) so that the edge 6 made around the periphery of the fabric 3 can be inserted between these two elements and that its free end is simply supported on the shoulder 9.

The spacing between the two ends of the two outer flanges 7*a* is such that it enables the insertion of the corresponding edges 6 of the fabric elements 3*a* and 3*b* between the pairs of flanges 7*a* and 7*b* of the two holding arrangements 7. Preferably, this spacing will be approximately equal to the spacing g existing between the end of the shoulder 9 and the outer flange 7*a*. Preferably, the distance g between the end of a large flange 7*a* and the plane of the large flange 7*a* of the opposite holding arrangement 7 will be equal to the distance h separating the shoulder 9 of the opposite holding arrangement from the large flange 7*a* associated with it (h=g).

It can thus be understood that the inclination of the two support elements 7 from the plane of the support plate 5 enables an entry passage for the edge that is common to the two pairs of flanges, so that this edge can be minimised.

According to the invention, this arrangement makes it possible to use the separating ribband 1 as a conventional ribband, since the user can choose either to begin by inserting the edge 6 into the separating ribband and stretching it onto the ribband on the opposite wall, or conversely, he can begin by inserting the edge into the opposite ribband and terminate by inserting it into the separating element after tensioning it.

The user can also use the device according to the invention if he wishes to adjust the existing space between the ends of the two outer flanges 7*a*, to bend the support plate so as to bring said ends towards each other or away from each other.

Figure 2:
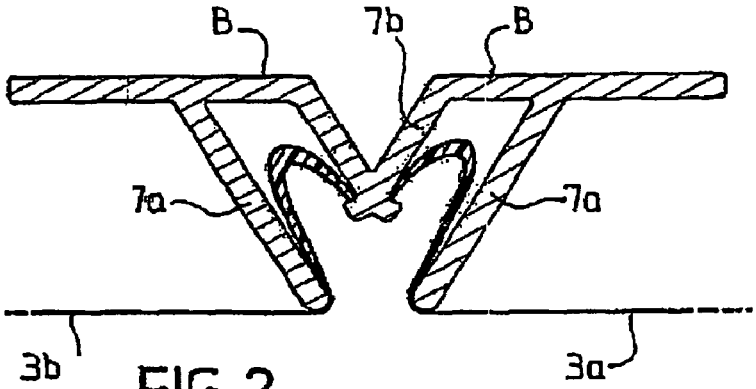

Thus as shown in FIG. 2, base B of the ribband may be interrupted at its centre by a "V" shaped notch.

Figure 3:
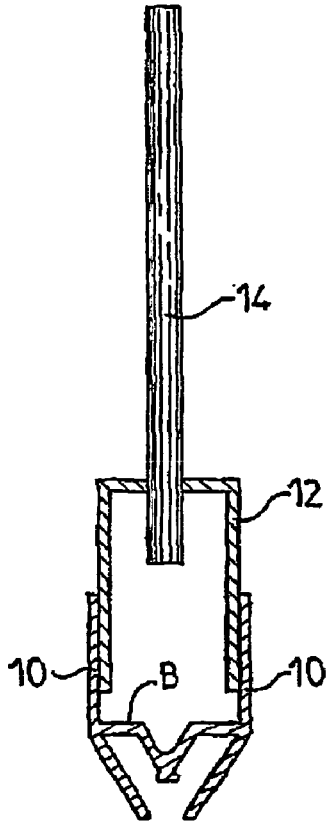
FIG. 3 shows a sectional view of another embodiment of a ribband according to the invention and means of holding it from the ceiling of a room.
Figure 4:
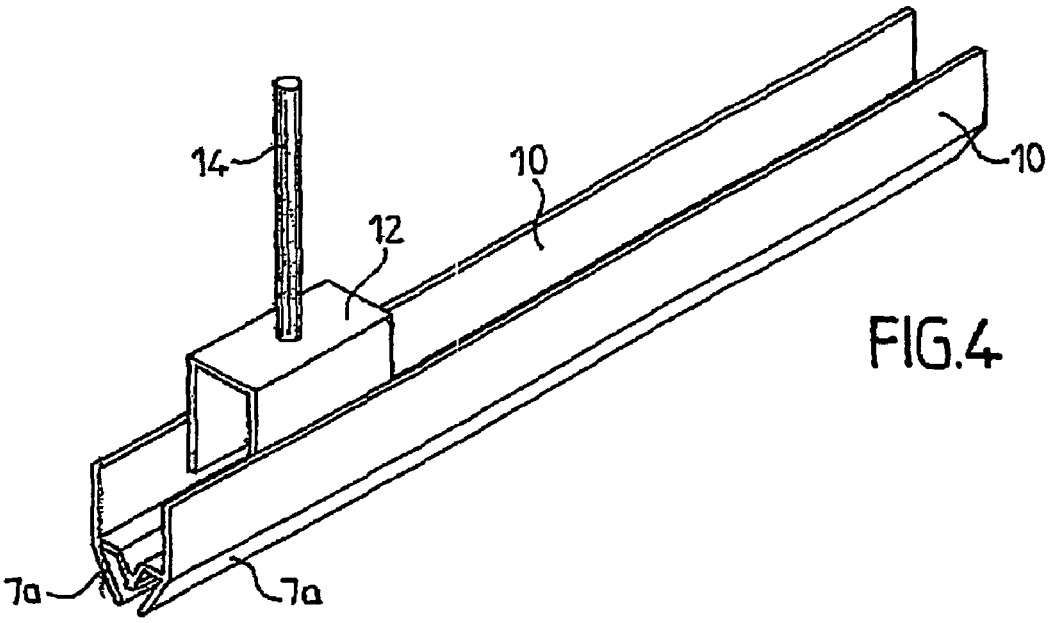
FIG. 4 shows a perspective view of the ribband and its suspension means shown in FIG. 3.

As shown in FIGS. 3 and 4, the base of each of the large flanges 7*a* extends opposite the holding arrangements 7 by a flange 10 perpendicular to the base B. The two flanges can cooperate with a stirrup 12 provided with a tie rod 14 fixed to the ceiling of the room, to support the ribband.

Obviously, the base plates may be provided with various attachment means to fix the separating ribband elements fixed to the ceiling or to a wall.

The separating ribband according to the invention could also be made in two parts that can be fixed together, that will he arranged side by side on a support element that can be a plate common to their base.

The invention claimed is:

1. A false wall, comprising:

a stretched piece of fabric (3) held around a periphery of the fabric (3) by an edge (6) that can be attached to ribbands fixed to a ceiling and/or walls of a room, in which the ribbands comprise a holding arrangement (7) having two parallel flanges (7*a*, 7*b*) at a spacing from each other, namely a first outer flange (7*a*) and a second lower inner flange (7*b*) that ends in a shoulder (9) that extends towards the first outer flange (7*a*) and ends at a distance (g) from the first flange (7*a*), to enable the edge (6) to pass through, such that the edge (6) can rest on the shoulder (9), wherein the ribband comprises a base (B) and two holding arrangements (7), for which the flanges (7*a*, 7*b*) are inclined from the base such that the first outer flanges (7*a*) converge towards each other and that their ends are separated such that a distance (h) between the end of the first outer flange (7*a*) and a plane of the first outer flange (7*a*) in the opposite holding arrangement is equal to the distance (g) separating the shoulder (9) of the latter holding arrangement from the first outer flange (7*a*) associated with the shoulder (9).

2. The false wall set forth in claim 1, wherein the two holding arrangements (7) are symmetrical about a plane (P) perpendicular to the base (B).

3. The false wall set forth in claim 1, wherein the flanges (7*a*, 7*b*) are inclined by about 45° from the base (B).

4. The false wall set forth in claim 1, wherein the base (B) is composed of a support plate (5).

5. The false wall set forth in claim 4, wherein the support plate (5) is provided with attachment elements on its face opposite the holding arrangements.

6. The false wall set forth in claim 1, wherein a bottom (13) of at least one of the first outer flanges (7*a*) extends on the opposite side of the holding arrangements (7), by a flange (10) perpendicular to the base (B).

7. The false wall set forth in claim 6, wherein each first outer flange (7*a*) extends on the opposite side of the holding arrangements by the flange (10) perpendicular to the base (B).

8. The false wall set forth in claim 7, wherein the first outer flanges (7*a*) cooperate with a stirrup (12) provided with a tie rod (14) fixed to the ceiling of the room, to hold the ribband.

9. The false wall set forth in claim 1, wherein the ribband is made in two parts that can be fixed together.

10. The false wall set forth in claim 9, wherein the two parts can be fixed to a plate common to their base.

11. A ribband for receiving an edge (6) of a piece of fabric to make a false wall, said ribband comprising:

a holding arrangement (7) having two parallel flanges (7*a*, 7*b*) at a spacing from each other, namely a first outer flange (7*a*) and a second lower inner flange (7*b*) that ends in a shoulder (9) that extends towards the first outer flange (7*a*) and ends at a distance (g) from the first outer flange (7*a*), to enable the edge (6) to pass through, such that the edge (6) can rest on the shoulder (9), wherein the ribband comprises a base (B) and two holding arrangements (7), for which the flanges (7*a*, 7*b*) are inclined from the base such that the first outer flanges (7*a*) converge towards each other and that ends of the first outer flanges (7*a*) are separated such that a distance (h) between an end of the first outer flange (7*a*) and a plane of the first outer flange (7*a*) in the opposite holding arrangement is equal to the distance g separating the shoulder (9) of the latter holding arrangement from the first outer flange (7*a*) associated with the shoulder (9).

12. The ribband set forth in claim 11, wherein the two holding arrangements (7) are symmetrical about a plane (P) perpendicular to the base (B).

13. The ribband set forth in claim 11, wherein the flanges (7*a*, 7*b*) are inclined by about 45° from the base (B).

14. The ribband set forth in claim 11, wherein the base (B) is composed of a support plate (5).

15. The ribband set forth in claim 14, wherein the support plate (5) is provided with attachment elements on its face opposite the holding arrangements.

16. The ribband set forth in claim 11, wherein the bottom (13) of at least one of the first outer flanges (7*a*) extends on the opposite side of the holding arrangements (7), by a flange (10) perpendicular to the base (B).

17. The ribband set forth in claim 16, wherein each first outer flange (7*a*) extends on the opposite side of the holding arrangements by the flange (10) perpendicular to the base (B).

18. The ribband set forth in claim 17, wherein the first outer flanges (7*a*) cooperate with a stirrup (12) provided with a tie rod (14) fixed to a ceiling of the room, to hold the ribband.

19. The ribband set forth in claim 11, wherein the ribband is made in two parts that can be fixed together.

20. The ribband set forth in claim 19, wherein the two parts can be fixed to a plate common to their base.

* * * * *